United States Patent [19]

Spanel et al.

[11] 4,254,718

[45] Mar. 10, 1981

[54] METHOD AND MEANS OF TUFTING

[75] Inventors: Abram N. Spanel, 344 Stockton St., Princeton, N.J. 08540; David R. Jacobs, New Canaan, Conn.

[73] Assignee: Abram N. Spanel, Princeton, N.J.

[21] Appl. No.: 95,751

[22] Filed: Oct. 23, 1979

[51] Int. Cl.[3] ..... D05C 15/00

[52] U.S. Cl. ..... 112/79 R; 112/118; 112/90; 112/102

[58] Field of Search ..... 112/79 R, 79 A, 90, 112/79 FG, 102, 118, 221, 266, 79.5, 410

[56] References Cited

U.S. PATENT DOCUMENTS

| | | | |
|---|---|---|---|
| 3,100,465 | 8/1963 | Broadrick | 112/79 R |
| 3,100,466 | 8/1963 | Ledford et al. | 112/79 R |
| 3,352,265 | 11/1967 | Cobble et al. | 112/79 R |
| 3,473,496 | 10/1964 | Hesz | 112/118 |
| 3,490,399 | 1/1970 | Hesz | 112/118 |
| 3,511,196 | 5/1970 | Hesz | 112/118 |
| 3,577,943 | 5/1971 | Watkins | 112/79 R |
| 3,670,672 | 6/1972 | Spanel et al. | 112/79 R |
| 3,865,059 | 2/1975 | Jackson | 112/79 R |
| 3,934,524 | 1/1976 | Smith | 112/79 R |

*Primary Examiner*—Ronald Feldbaum
*Attorney, Agent, or Firm*—Steele, Gould & Fried

[57] ABSTRACT

A tufting method and apparatus for tufting yarn to a backing layer, including individual tufting elements, comprising, means to control forward and lateral displacement of successive needle strokes. A preferred embodiment includes means to select particular yarns for tufting from a plurality of yarns and means to select the length of yarn to be tufted. In a further preferred embodiment a reduced number of tufting elements is contemplated with the elements spaced so as to enable the production of a full sized tufted product by lateral shifting of the backing layer to provide for intermediate tufting positions.

20 Claims, 5 Drawing Figures

METHOD AND MEANS OF TUFTING

BACKGROUND OF THE INVENTION

The subject disclosure relates to a method and apparatus for tufting and particularly, to enable the production of a tufted product from a modified machine having many fewer parts than previously necessary.

In recent years the "Spanel Tufting System" involving multi-color tufting has been developed under the direction of Abram N. Spanel, a coinventor of the subject disclosure. Multi-color tufting has been a primary objective of the system with the purpose to enable the tufting of different color yarns for each tufting stroke. Under such a system, the production of detailed colored pictorials can be readily accomplished since yarn selection means can be included to choose a particular yarn from a plurality of yarn choices for each of the tufting strokes. With a "Spanel" tufting machine having on the order of 1200 needles, if there is a choice of, for example, five or eight colors for each needle stroke of the 1200 needles, it readily can be appreciated that a painting or other picture can be precisely and accurately reproduced in the form of a tufted product.

More precisely, the Spanel system utilizes pneumatic means to transport yarn to tufting stations, either in metered lengths of unsevered yarn or discrete yarn bits. The yarn is then tufted by needle or other bit-applying means to a backing layer to form a tufted product such as a rug.

Aspects of the Spanel system are disclosed in U.S. Pat. No. Re. 27,165 and U.S. Pat. No. 3,554,147, such as the concept and fundamental apparatus for selecting one of an array of yarn color strands and then transporting the yarn strand or a severed yarn bit to a needle station for tufting. A number of Spanel improvement patents disclose improved means of selecting yarn for the tufting stations. Basically, however, in the Spanel patents, regardless of the type of yarn selection system, yarn strands were metered by metering devices and fed pneumatically to a magazine or collator with multiple selection yarn tubes either leading directly to tufting stations or merging into a common passageway leading to the tufting stations. The metering device in the aforementioned U.S. Pat. No. 3,544,147 includes yarn brakes and yarn pullers which are individually actuated but which co-act to meter a length of yarn for yarn selection. Thus these Spanel patents disclose apparatus to select and meter a length of yarn for each of the needle stations.

For a full size "Spanel" tufting machine having on the order of 1200 needles, if there is to be a color selection of eight colors per needle then a total of 9600 cones of yarn are necessary with each having an independent yarn feeding and metering system. The tremendous cost and space requirements for such a machine are readily apparent.

As will fully be described herein, backing layer movement and control techniques have been developed to enable the elimination of a considerable number of needles, yarn cones, and yarn feeds by a factor as for example of eight. In effect, all apparatus concerned with handling yarn is reduced by a factor of eight while the overall dimension of the machine and the size of rug produced thereon remain the same.

Such a reduction in components is enabled in large measure by the ability to precisely control feeding of the backing layer as described herein. The backing layer of the subject disclosure is advanced and this advancement can be precisely controlled. In contrast, most conventional tufting operations utilize continuous feed of the backing layer which is not readily adjustable.

Additionally, backing movement control is disclosed herein which enables the lateral shifting of the backing layer. Backing shifters per se are well known in the carpet industry with the first ones being called "wavy-line" units. An eccentric wheel was used with an adjustable slot in the middle to enable adjustment of the shift to be made and once adjusted, the machine was permitted to keep running to produce what was known as wavy-line carpet. Such a procedure became well known with chenille bedspreads.

As disclosed herein, with programming and complete adjustability of the backing shifter, it will be appreciated by virtue of the backing feeding and backing shifting control, the precise location or placement of the needles into the backing layer is obtained.

Some of the improvements with the backing shifter of the subject disclosure can best be appreciated by viewing the use of backing shifters in conventional tufting machines. Conventional tufting machines, usually have needle plates placed below the needles with yarn being fed downwardly therethrough. In a conventional loop pile machine, the tuft hook is positioned below the needle plate. The backing flows over the top of the needle plates with backing fingers being used to support the backing and support the penetration load of the needles. Since the loops are continuous as they are formed on the face below the backing, it is not possible to effectuate the backing shift in the needle area because of the needle plate location. Accordingly, in a conventional tufting machine, the pin roll which is used is positioned at a distance permitting tangential engagements of the backing layer only. Thus, with the pin roll placed approximately two and a half inches from the needle location, it is necessary to move the backing approximately three-quarters of an inch to achieve a three-sixteenths inch movement at the needles. Thus is due to both the location of the pin rolls and the natural drag which is encountered because the loops are hooked onto the needle plate fingers in the proximity of the needle station.

As disclosed herein, since the pin roll is placed in close proximity to the needles, backing layer control very close to the needle station can be achieved. In view of this positioning of the pin roll, since there is no drag because of the nature of the tufting operation, it is geometrically predictable precisely how far the backing layer will move adding to the ability to precisely control a tufted product. Further, in the subject specification, the backing layer is moved in steps as distinguished from the conventional machine where the backing is in continuous motion creating a much higher drag factor.

With such control, it becomes feasible to laterally shift the backing layer in stepped manner with proper drive means so that a number of tufts such as eight can be tufted successively in a lateral direction by each needle. This in turn enables the removal of a considerable number of needles as alluded to previously and as will be fully discussed herein.

SUMMARY OF THE INVENTION

Accordingly, it is an overall object of the subject invention to provide a method of tufting and tufting apparatus which will produce a product with complete color control but with fewer components than previously possible.

It is a more specific objective of the subject invention to provide a backing control system with unequaled control to precisely position the backing layer before each tufting step occurs.

It is a further specific objective of the subject invention to provide backing layer movement means which includes adjustment means for the advancement of said backing layer and shifting means for controlling lateral movement of said backing layer.

It is still one more specific objective of the subject invention to provide control means to simultaneously control the selection and feeding of yarn and the movement of the backing layer.

It is a further objective of the invention to provide a means for eliminating numerous needles and yarn supplying components from the apparatus which objective is carried out by the development of highly refined and engineered backing control means which enables side shifting of the backing to have each needle tuft a plurality of lateral needle strokes.

It is another objective of the subject invention to provide tufting apparatus which is not limited to producing tufted carpet of a specific gauge.

BRIEF DESCRIPTION OF THE DRAWINGS

For a more detailed understanding of the invention, reference is made in the following description to the accompanying drawings in which.

DETAILED DESCRIPTION

Figure 1:
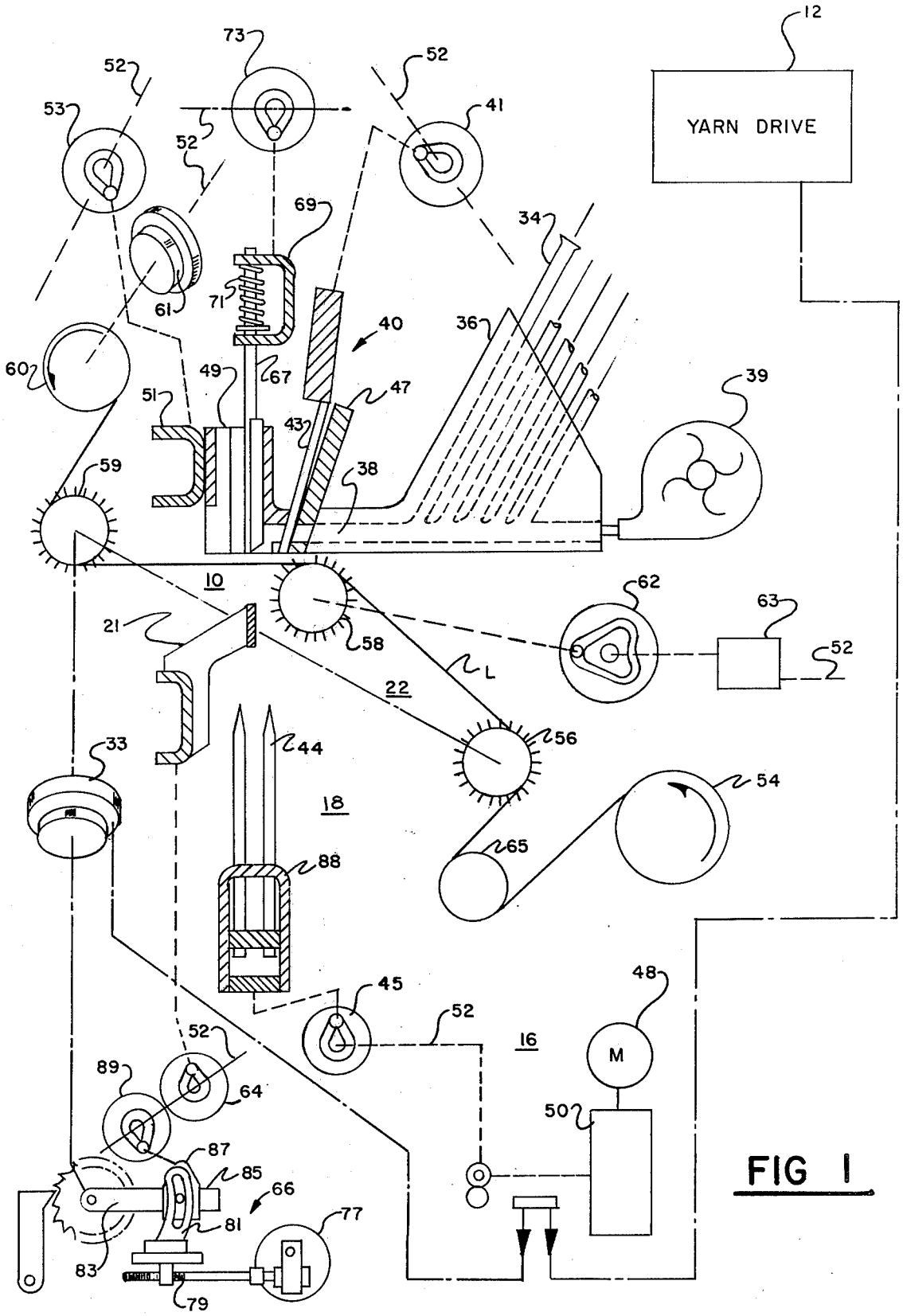
FIG. 1 is a schematic overall view showing the basic elements of a tufting machine as described herein.

With reference to FIG. 1, a schematic overall view is shown setting forth the major elements of the subject application. The tufting station 10 is shown which, as will be described in detail, comprises a series of tufting elements which may be on the order as described in aforementioned U.S. Pat. No. Re. 27,165. In the preferred embodiment, however, only one tufting element for every eight tufting elements of a full sized machine is used.

A yarn supply and metering station 12 is shown which may comprise a series of yarn bobbins and yarn delivery means per each of the tufting elements. With the machine of the preferred embodiment, it is contemplated that in place of 1200 needles of a full size machine (see copending application Ser. No. 71,164) only 150 needles or tufting elements will be used with each needle station having the selection capability of five or eight types or colors of yarn. Accordingly, the yarn supply area may include a yarn creel system having 750 yarn bobbins.

The yarn metering system may be on the order of that disclosed in aforementioned U.S. Pat. No. 3,544,147 or it may be on the order as disclosed in U.S. Pat. Nos. 3,937,157 and 4,047,491.

A yarn selection control mechanism 16 may be on the order as that shown in copending application Ser. No. 71,164. As discussed therein, a number of different types of yarn selection systems are contemplated depending upon the type of carpet desired and the level of sophistication necessary to produce the desired result. For example, the yarn selection control may comprise a scanning apparatus to gather data from a pictorial to be reproduced and transform the data into the necessary signals for selecting the particular color of yarn to be used in the pattern to be reproduced. In like manner, yarn density may be controlled by selecting yarn of a particular denier and further calling for a specified length of such yarn for each of the tufting strokes.

A needle mechanism 18 is disclosed which may be on the order as that disclosed in U.S. Pat. No. 4,127,078.

A backing feed mechanism is shown which will control the feeding of the backing so that various distances between placement of successive rows of needles may be controlled. This is important for a machine which will make a plush short-tuft carpet in one run and make a shag carpet in the next production run or alternatively combine both operations in a single rug.

Pneumatic yarn transportation tubes 34 are shown leading from the yarn supply and metering station 12 to a yarn collator 36 where the individual yarn transportation tubes 34 merge into a common yarn transportation tube 38 leading to the tufting station 10. A pneumatic source 39 schematically shown provides the pneumatic supply for the pneumatic transport of the yarns. Yarn severing means 40 on the order of that disclosed in U.S. Pat. No. 4,119,047 is shown being controlled by cam member 41 while needles 44 and needle bar 88 are shown being driven by cam member 45. The severing means 40 comprises a moving blade 43 which coacts with a stationary blade 47 as fully described in U.S. Pat. No. 4,119,047. The needles 44 may be dual shank needles having aligned eyes on the order of those disclosed in aforementioned U.S. Pat. Nos. 3,554,147 and Re. 27,165. In accordance with the method of tufting disclosed in the aforementioned patents, a discrete length of yarn is placed through the aligned eyes of the needle shanks to be tufted into a backing layer.

In place of needles 44, stomper-like bit-applying elements as disclosed in U.S. Pat. No. Re. 27,165 may be used to push the yarn into adhesive attachment with a backing layer L.

A motor 48 is shown driving the tufting apparatus through transmission 50 which may be a train of gears or related mechanism. A power transmission means 52 is schematically shown running throughout the device from which the various drive mechanisms operate. As shown, yarn severing cam means 41 and needle cam means 45 operate off power transmission means 52.

The backing layer L onto which yarn is tufted is shown passing tufting needles 44. The backing layer L is fed from supply roll 54 to pin roll 56, around shifting roll 58 to pin roll 59 to the doff roll 60. The doff roll 60 is a rubber covered roll which is a type of roll used widely in the industry. It is controlled by magnetic clutch 61 operating off power transmission means 52 and its function is to pull the tufted material off the pin roll 59. The shifting roll 58 is shown being controlled by cam means 62 and transmission 63 as driven by power transmission means 52. A staging bar positioner 65 controls the angle of approach of the backing layer L to pin roll 56. The backing layer L is advanced as pin rolls 56 and 59 are driven off power transmission means 52 by cam 89. The control of the amount of backing layer advancement is through electric gear motor 77 which is shown in engagement with threaded rod 79 which is received by adjustment carrier 81. Ratchet 83 is driven by cam 89 through lever arm 85 and adjustable sleeve 87. A magnetic clutch 33 operates off of main shaft 52 and is controlled by clock pulses as shown in FIG. 1 to control the timing as to when the backing layer advancement will take place.

The pin feed rolls 56 and 59 are shown as being driven by adjustable feeding means 66 which operates off of transmission means 52.

A yarn adjuster 49 is shown having yarn adjuster carrier bar 51 linked to eccentric member 53. The yarn adjuster 49 is fully disclosed in U.S. Pat. No. 4,127,078 and provides the tufting apparatus with the capability of selecting and tufting yarn of different lengths to produce tufts of different pile heights either on the same or different rugs.

Yarn bit clamps 67 are shown which clamp the yarn against backing layer L prior to tufting. The yarn bit clamps 67 shown having a bit clamp carrier bar 69, spring means 71, and cam driving means 73 are fully disclosed in U.S. Pat. No. 4,111,136.

As disclosed in U.S. Pat. No. 4,127,078, a shiftable support member 21 is provided opposite the clamps 67 to provide support for the backing layer L. The support member 21 is controlled by cam member 64 and is cleared from its support position as the backing layer L is advanced.

Figure 2:
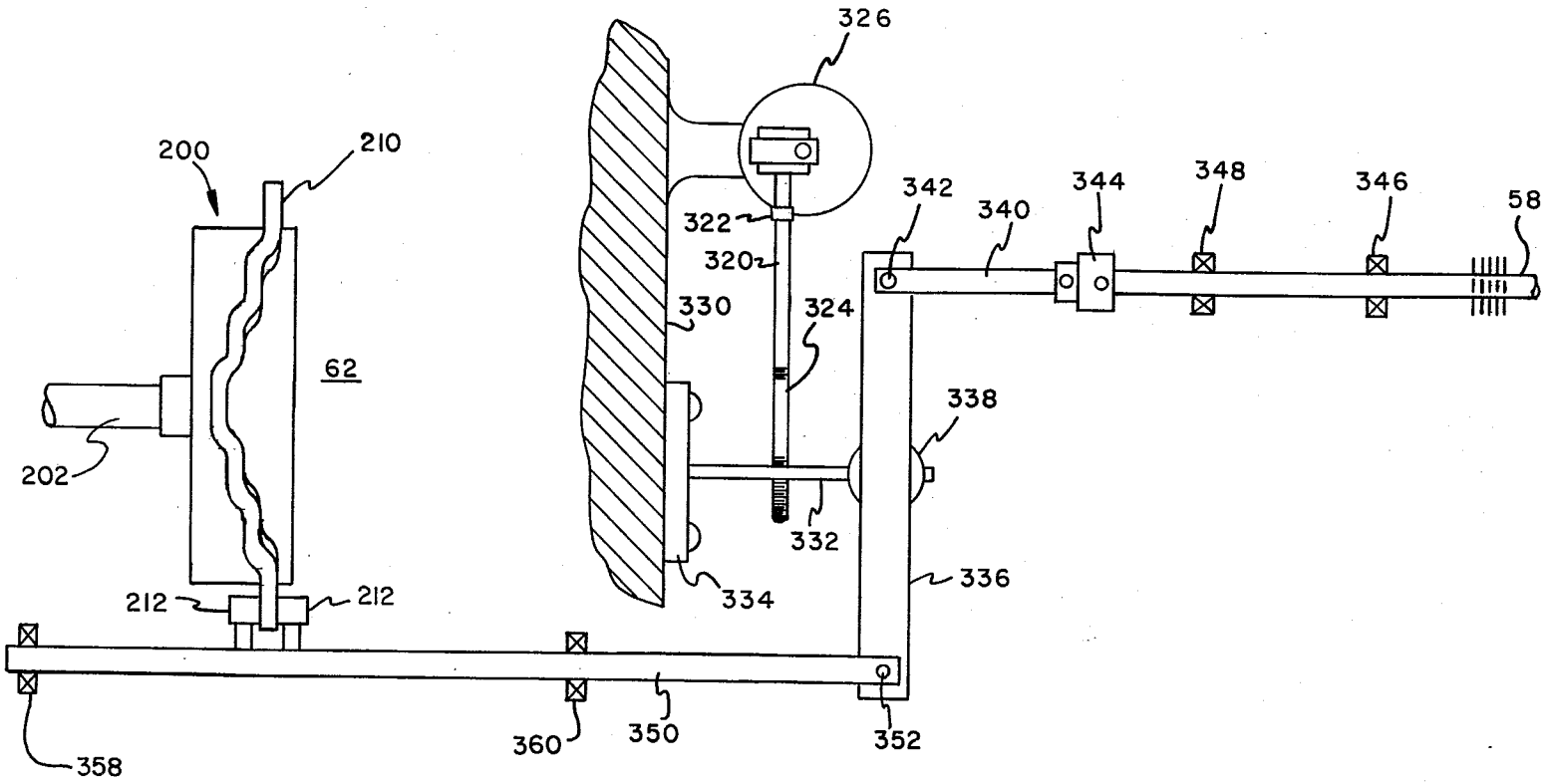
FIG. 2 is a schematic view of a backing shifting mechanism.

With reference to FIG. 2, the adjustable backing shifter of the subject tufting apparatus is disclosed. An adjusting arm 320 is shown having an adjusting or crank end 322 and a threadable end 324. The adjusting arm 320 is rotatably mounted to be driven by gear motor 326. Gear motor 326 is securely and rigidly mounted to a bearing surface 330.

The threadable end 324 of adjusting arm 320 is threadably received by set arm 332 which is adjustable to various vertical levels. The set arm 332 is slidably mounted within confining structure 334 that is in turn mounted to bearing wall 330. The adjustability of the backing shifter is enabled by a pivot lever 336 having an adjustable center pivot bearing 338 which position is obtained by the adjustment of set arm 332 which raises or lowers the adjustable center pivot bearing 338 as adjusting arm 320 is cranked.

The pivot lever 336 is pivotally mounted to connecting link 340 by pivot pin 342. A connecting link 340 is mounted to coupling 344 which permits the shifter shaft 58 to rotate as facilitated by linear bearings 346, 348. The base of pivot lever 336 is pivotally mounted to connecting link 350 by means of pivot pin 352. Connecting link 350 extends to cam followers 212, the latter which is engageable with cam drive 62 (see FIG. 1). Linear bearings 358, 360 are shown on connecting link 350.

Once the adjustable center pivot bearing 338 is positioned or adjusted by means of adjusting arm 320, the cam drive will cause horizontal motion in connecting link 350, which will be transmitted in varying amplitude to connecting link 340 as determined by the position of adjustable center pivot bearing 338. Thus, with the rotating shifter shaft 58 being infinitely adjustable to provide programmable linear motion, the backing layer L may be shifted horizontally to determinable positions to receive each of the series of needle strokes.

As shown in FIG. 2, cam 62 is shown to be a type of barrel cam 200 with many cam lobes 210. In place of this type cam with stepped lobes, the apparatus could function with a simple drive cam so that the shaft output would be a back and forth motion. The latter cam would be used, for example, when a full complement of tufting needles is used, as for example to produce dense carpet. As discussed in copending application Ser. No. 71,164 even though needles of set gauge are utilized, it may, nevertheless, be desirable to shift the needles slightly for patterning effect and to produce a rug of denser pile than as permitted by the gauge which the needles are set at.

On the other hand, if it is desired to use the backing shifter shown in FIG. 2 on tufting apparatus having needles spaced apart so that only every eighth needle or so is present, then it becomes necessary to have the backing layer shift time and again in the same direction to allow each of the needles to tuft eight successive lateral tufts before the backing is advanced further. For such apparatus, the backing shifter of FIG. 2 may be used with a multi-step cam device such as the barrel cam shown as 200 in FIG. 2.

Figure 2A:
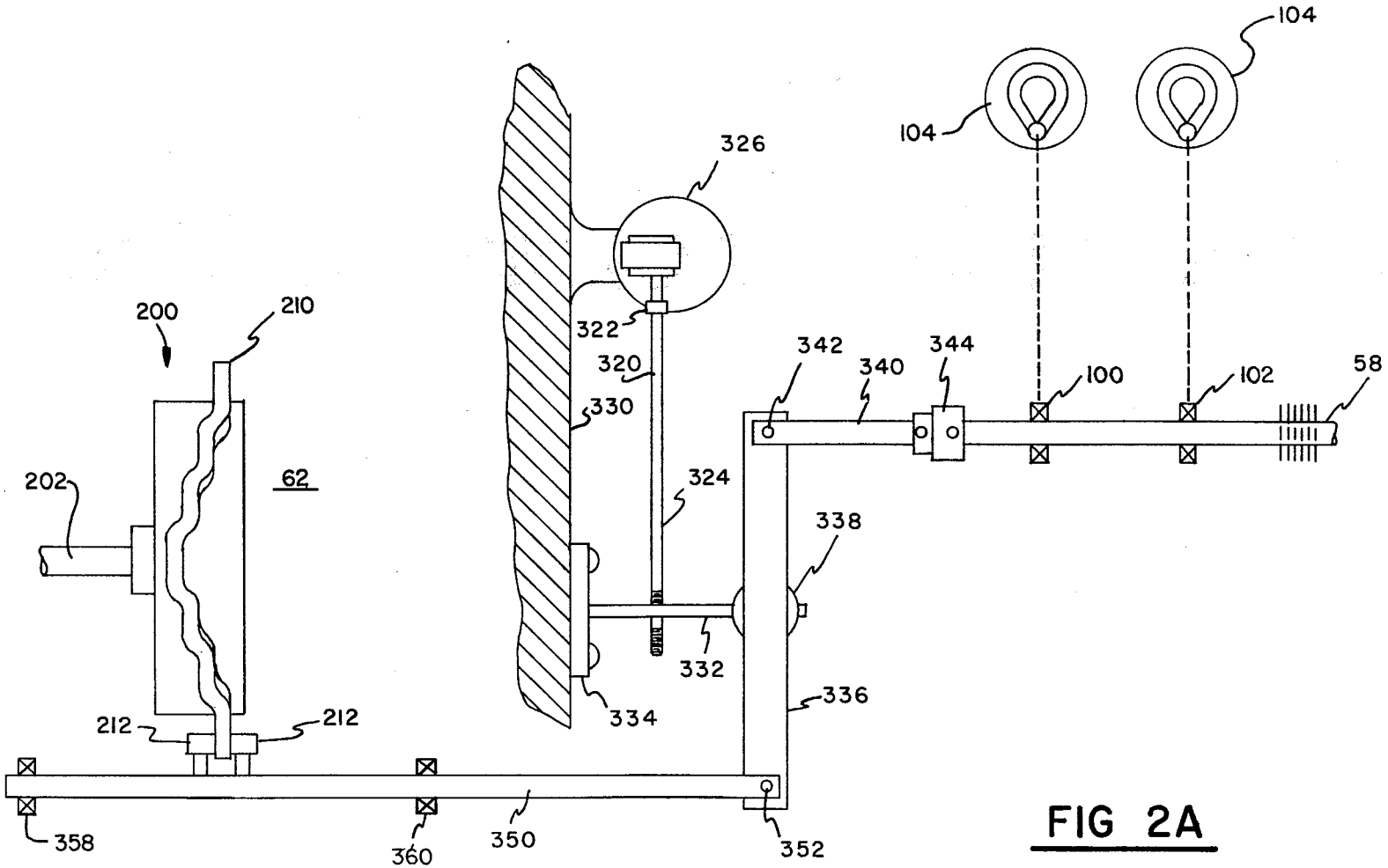
FIG. 2A is a schematic view of an alternate embodiment of a backing shifting mechanism.
Figure 6:
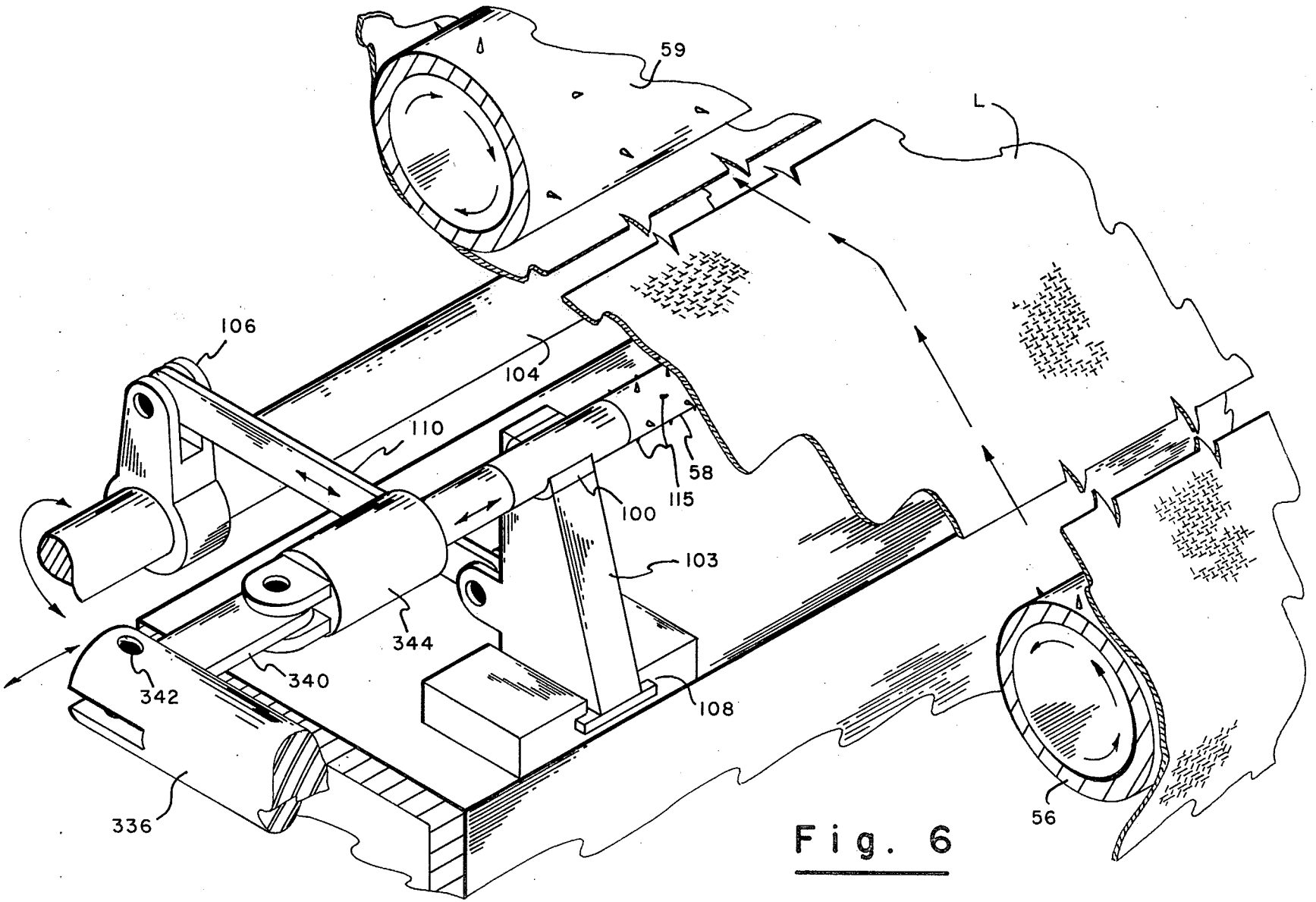
FIG. 6 is an isometric view of the backing shifting mechanism of FIG. 2A.

With respect to FIG. 2A, an alternate embodiment of the backing shifter of FIG. 2 is shown. In reviewing FIG. 2A, reference may be also made to FIG. 6 which shows actual detail of the apparatus schematically shown in FIG. 2A. The pin roll shaft 58 is mounted in bearings 100, 102. The bearing post 103 rides in bearing gib 108 and is connected to connecting link 110 which is pivotally mounted to the drive lever 106 of cam shaft 104. As the cam shaft 104 rotates, linear movement is imparted through the bearing structure to pin roll 58. This movement can be either simultaneous with the lateral shifting of pin roll 58 or it can be made in the absence of lateral movement of pin roll 58.

In comparing FIGS. 2 and 2A, it will be seen that in FIG. 2 since pin roll 58 cannot move in the direction of the backing layer, the pin roll rotates freely as the backing layer L engages the pin roll pins 115 during its motion. In FIG. 2A, if the backing layer is moving forward the same time as connecting link 110, the pin roll 58 will not rotate but will move forward at the same rate as the backing and if the pin roll is being shifted laterally simultaneously, then in effect diagonal movement of the backing layer is taking place. Thus from the combination of movements in FIG. 2A, the backing can be advanced unidirectionally toward the take up roll 59, it can be moved laterally with respect to the needles or it can be moved diagonally depending on the patterning effect called for.

Figure 3:
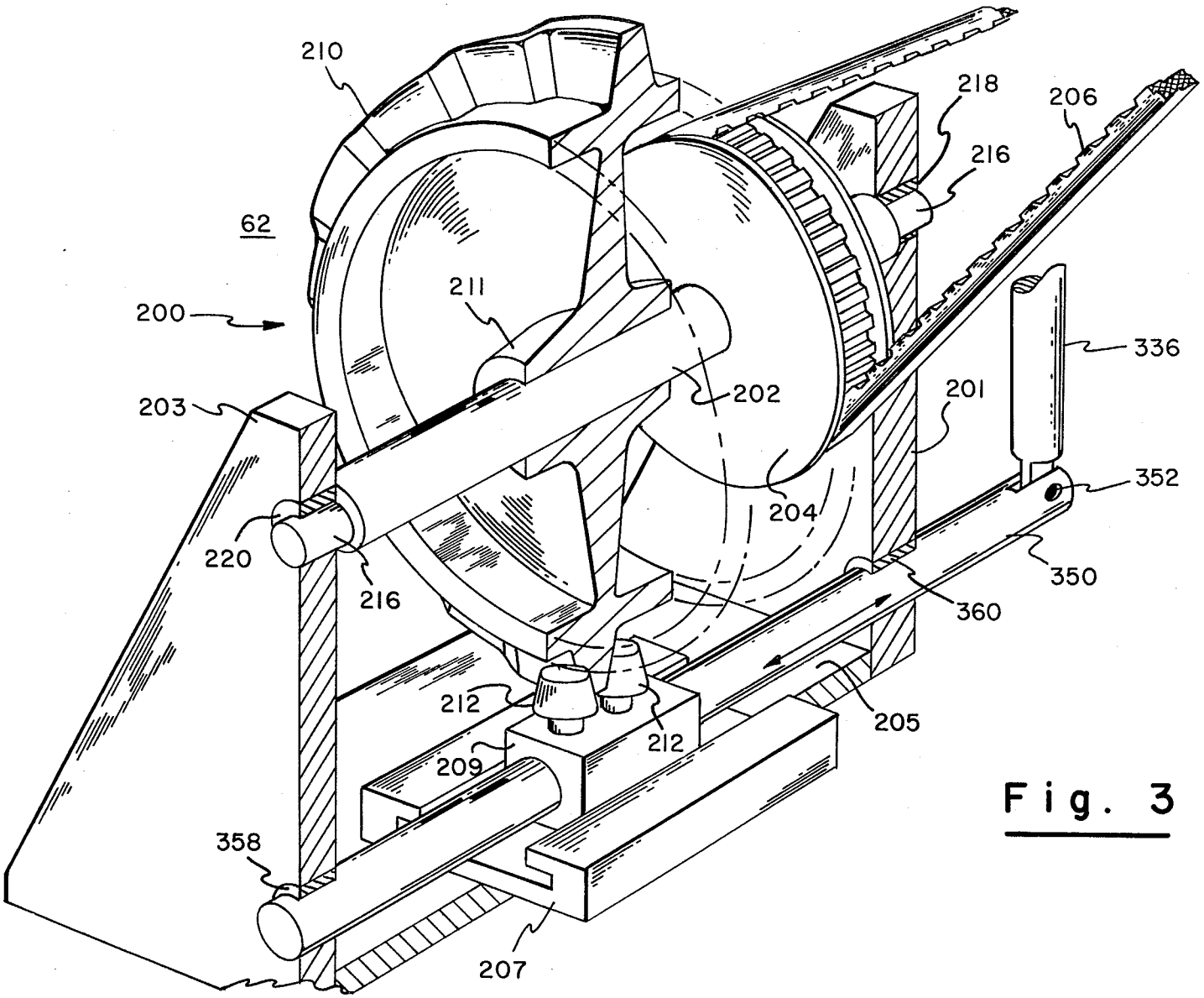
FIG. 3 is a partial isometric view of a barrel cam used to drive the backing shifting mechanism.

With reference to FIG. 3, the particular type of cam 62 shown is a barrel cam 200 which will provide the type of continuous stepping motion to have the backing layer shifting continuously to a plurality of tuft positions. It is to be understood that equivalent types of cams such as face cams, straddle cams or any type of mechanism to produce interrupted motion may be used.

The barrel cam 200 is shown mounted on drive shaft 202 by cam mounting hub 211. The cam 200 has stepping cam lobes 210 around its periphery. Supporting posts 201 and 203 extend from frame 205 and support the stepped down portions 216 of the drive shaft 202. Bearings 218 and 220 permit the rotation of drive shaft 202 which is stepped down at its extremities to enable precise support without the possibility of lateral movement of drive shaft 202 as prevented by the walls of supporting posts 201 and 203. The drive shaft 202 is driven by drive sprocket 204 rigidly mounted to drive shaft 202 and aligned with gear belt 206 extending from a drive power shaft, not shown. The connecting link or linear reciprocating shaft 350 which is pivotally mounted to the lever 336 by pivot pin 352 (see FIGS. 2, 2A and 3) is supported on support posts 201 and 203 with movement allowed by support bearings 358, 360. The link or shaft 350 is rigidly secured to cam truck 209 which is slidably mounted within gib bearing 207. The cam followers 212 which engage cam lobes 210 are mounted on cam truck 209 and will cause linear motion of shaft 350 as they engage the cam lobes 210.

Figure 4A:
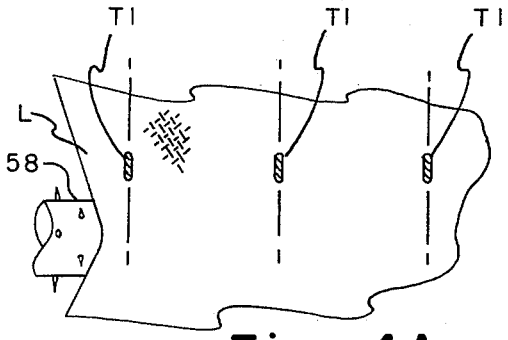
FIG. 4A through FIG. 4H are sequential views of a backing layer showing tufts of three successive needle stations.

With reference to FIGS. 4A–4H, a sequential series of tufts as implanted into the backing layer L are shown. To obtain the pattern of FIGS. 4A–4H, the backing shifter of either FIGS. 2 or 2A is utilized with a stepping type of cam arrangement as shown in FIG. 3. The spacing of tufts as shown in FIGS. 4A–4H is occasioned by having needles spaced apart, so that only every eighth needle remains. As shown in FIG. 4A, the first tufts T1 of three needles are implanted.

Figure 4E:
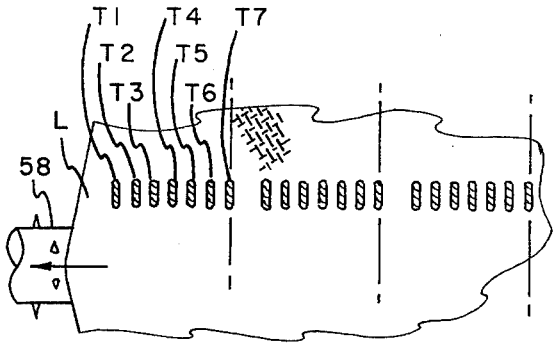
Figure 4B:
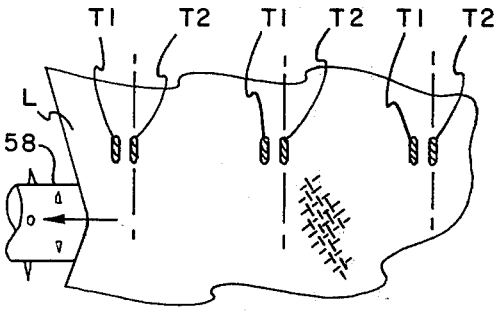
Figure 4F:
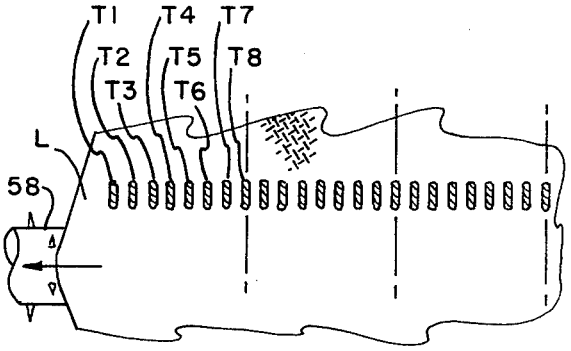
Figure 4C:
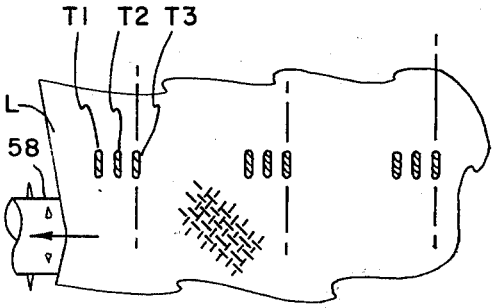
Figure 4G:
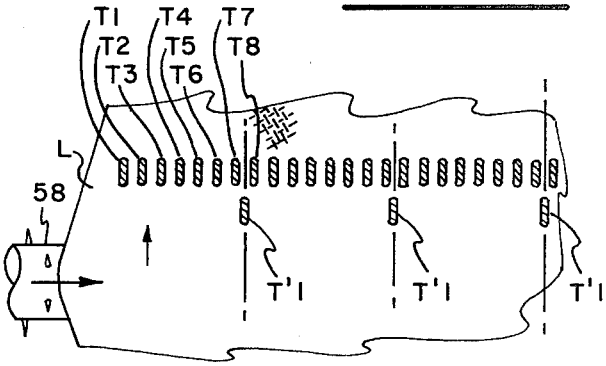
Figure 4D:
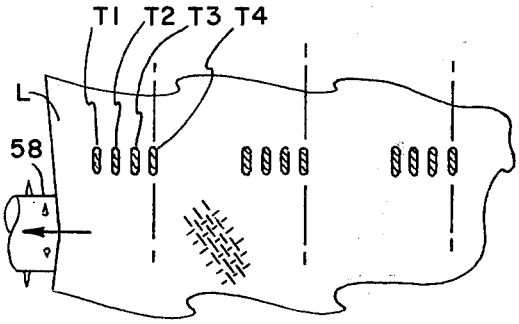

Proceeding to FIGS. 4B, 4C and 4D, the second, third and fourth tufts are tufted by each of the three needles as the backing layer shifts laterally between the tufting needles. FIG. 4E shows the backing layer after seven tufts, T1–T7 have been tufted by each of the needles and FIG. 4F shows the backing layer after eight tufts have been made by each needle. FIG. 4F shows 24 tufts in a row which would be the equivalent of having all 24 needles in place instead of the three needles which produced the tufts of 4F by laterally shifting the backing layer.

Figure 4H:
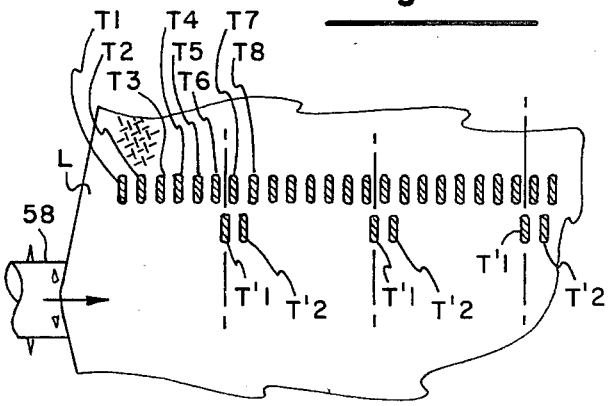

FIGS. 4G and 4H show the first and second tufts respectively of a new row following the advancement of the backing layer to the space for the next row. It will be seen that T'1 is not directly in line with T8 of the previous row but is offset slightly to eliminate a corn row type effect of the tufted material. Such partial movement is controlled by the cam facing structure.

Figure 5:
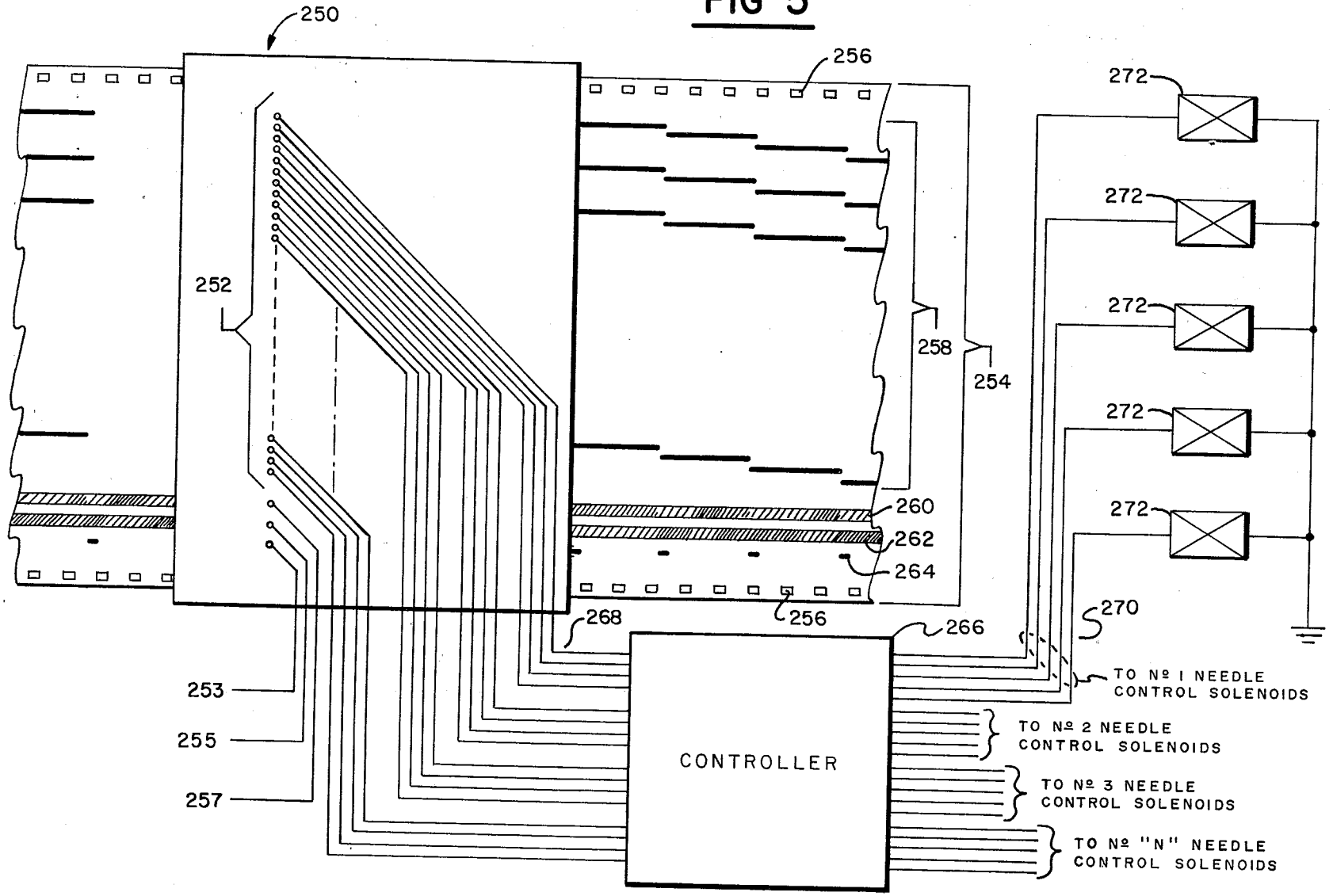
FIG. 5 is a functional block view of a pattern reader and electronic yarn feed control.

With reference to FIG. 5, a pattern control device is shown which is to be considered as merely representative of many such devices which could be used in conjunction with the subject invention. A reader head 250 is shown having photo cells 252 to select colors. A pattern tape 254 with guide perforations 256 is shown passing beneath reader head 250. Markings 258 are shown which indicate the color of yarn to be selected for each tuft. In addition to the photo cells 252 which scan the colors, photo cells 253, 255 and 257 are intended to control the backing feed adjustment, to control the magnitude of the side shifter, and to actuate the magnetic clutch 33 (FIG. 1) for advancing the backing layer. Corresponding data is shown on the tape 254 where side shifter data is shown as 260, backing feed adjustment data is shown as 262 and the backing advancement control data is shown as 264. It will be appreciated that the data 264 is shown to represent approximately every eighth needle stitch which would be the type of data control to advance the backing in 4G after a row of tufts has been completed. Effectively, after every eighth stitch of the machine, photo cell 257 would turn the clutch 33 on causing the backing to proceed through the machine to the next stitch location.

A controller 266 is shown which will amplify the weak signals from the photo transistors to signals which the solenoids 272 can accept and operate. The leads from the photo cells 252 to the controller are shown as 268 and the leads from the controller 266 to the solenoids 272 are shown as 270.

It will be observed that for each needle, four leads extend from the photo cells 252 to controller 266, while five leads for each needle extend from the controller 266 to the solenoids 272. Thus, if there is no input from the pattern tape, the controller 266 is automatically to turn the fifth solenoid on which may be the background carpet color.

It will be appreciated that conventional tufting machines have needles which are set in position one to another so as to establish various gauges for the tufting. Thus, the needles may be an eighth of an inch apart or three-sixteenths of an inch apart to produce one-eighth inch gauge carpet or three-sixteenths inch gauge carpet respectively. It is important to note that tufting apparatus on the order as disclosed herein is not limited to a particular gauge. Through movement of the backing layer laterally by controlling mechanism, stitches can be laterally positioned at any desired distance one from the next. Thus, from carpet run to carpet run, the gauge may be changed or it may be changed within a particular carpet to provide a patterning effect.

It is important to note the modular capabilities of the subject apparatus described herein. Rather than start with a full size machine having 1200 needles with corresponding yarn selection, metering, and feeding capabilities, a carpet manufacturer may start production with a machine having less components as for example one-eighth of the total or 150 needles and corresponding components. It is to be understood that any reduction in needles may take place within the range of the lateral shifting capability and the reduction by eight fold is only an example. The effects of such modular capability are pronounced.

While the overall dimension of the machine and the final product remains the same, all apparatus concerned with handling yarn is reduced by a factor which corresponds to the reduction of needles. For example, once again if needle placement calls for removing seven needles leaving one, etc., then one-eighth the number of needles will be required, one-eighth the number of passage selectors, one-eighth the number of yarn feeds, etc. While this obviously reduces manufacturing costs of the original piece of equipment, the reliability factor also goes up by necessity by a factor much greater than eight to one. The mere reduction in necessary compactness as required by a full machine is important.

Also the initial inventory requirements in yarn for the user of the machine are greatly reduced. Whereas approximately 10,000 cones of yarn would be necessary for the full size machine with color selection, only one-eighth of this number will be necessary if the needle number is reduced by a factor of eight.

The present invention may be embodied in other specific forms without departing from the spirit or essential attributes thereof, and accordingly, reference should be made to the appended claims, rather than to the foregoing specification as indicating the scope of the invention.

I claim:

1. Tufting apparatus or the like comprising:

tuft applying elements;

means to feed yarn to said tuft applying elements; and backing layer movement means including:

(a) adjustable means for advancing said backing layer;

(b) means of adjusting lateral movement of said backing layer and (c) means of advancing the backing layer responsive to lateral movement.

2. The tufting apparatus of claim 1 further including joint means to control the movement of the backing layer.

3. The tufting apparatus of claim 2 wherein said joint means comprises backing layer control information from a control source.

4. The tufting apparatus of claim 3 wherein said backing layer control information includes information for adjusting the advancement of said backing layer and for controlling lateral movement of said backing layer.

5. The tufting apparatus of claim 1 further including control means to simultaneously control the selection and feeding of yarn and the movement of the backing layer.

6. The tufting apparatus of claim 5 wherein said control means comprises stored information having yarn selection data, and backing layer control data.

7. The tufting apparatus of claim 1 wherein said backing layer movement means includes a shifting roll for effectuating lateral movement of said backing layer.

8. The tufting apparatus of claim 7 wherein said shifting roll is positioned adjacent the location where said tuft applying elements penetrate the backing layer.

9. The tufting apparatus of claim 7 further including drive means, linkage and a lever mounted at a bearing point determined by said linkage.

10. The tufting apparatus of claim 1 wherein said tuft applying elements are spaced laterally at intervals greater than the distance at which tufts are to be laterally placed and said backing layer movement means includes means to move the backing layer laterally to positions to receive tufts from the tuft applying elements.

11. Tufting apparatus or the like comprising:

tuft applying elements spaced laterally at intervals greater than the distance at which tufts are to be laterally placed;

means to feed yarn to said tuft applying elements; and backing layer movement means including means to move the backing layer laterally to positions to receive tufts from the tuft applying elements.

12. The tufting apparatus of claim 11 wherein said backing movement means includes means to move the backing layer back and forth in a lateral direction.

13. The tufting apparatus of claim 11 wherein said backing movement means includes means to move the backing layer to a plurality of lateral positions to receive a plurality of needle strokes.

14. The tufting apparatus of claim 11 wherein said backing movement means includes means to advance the backing layer after lateral movement.

15. The tufting apparatus of claim 11 further including means to sever yarn.

16. The tufting apparatus of claim 11 including structural means to receive additional tuft applying elements.

17. The tufting apparatus of claim 11 wherein said means to feed yarn includes pneumatic yarn transportation means.

18. The tufting apparatus of claim 11 further including yarn selection means for said tuft applying elements.

19. The tufting apparatus of claim 11 wherein said means to move the backing laterally includes a stepped drive cam.

20. The tufting apparatus of claim 11 wherein said means to move the backing laterally includes a pin roll, support bearings for said pin roll and a connecting shaft.

* * * * *